US006000418A

United States Patent [19]

Kern, Jr. et al.

[11] Patent Number: 6,000,418

[45] Date of Patent: Dec. 14, 1999

[54] INTEGRATED DYNAMIC FLUID MIXING APPARATUS AND METHOD

[75] Inventors: Frederick W. Kern, Jr.; William A. Syverson, both of Colchester, Vt.

[73] Assignee: International Business Machines Corporation, Armonk, N.Y.

[21] Appl. No.: 08/820,859

[22] Filed: Mar. 20, 1997

[51] Int. Cl.[6] ..... E03B 1/00

[52] U.S. Cl. ..... 137/7; 137/209; 137/605; 137/896

[58] Field of Search ..... 137/602, 888, 137/889, 893, 892, 605, 209, 206, 896, 7

[56] References Cited

U.S. PATENT DOCUMENTS

| | | | |
|---|---|---|---|
| 945,143 | 1/1910 | Szamek | 137/889 |
| 2,039,275 | 4/1936 | McGrael | 137/605 X |
| 2,265,737 | 12/1941 | McMahan | 137/602 X |
| 2,973,718 | 3/1961 | Deutsch | 137/889 |
| 3,042,077 | 7/1962 | Waddington et al. | 137/889 |
| 3,167,091 | 1/1965 | Holdren | 137/889 |
| 3,188,055 | 6/1965 | Lutjens et al. . | |
| 3,304,564 | 2/1967 | Green | 137/889 |
| 3,416,567 | 12/1968 | Von Dardel et al. | 137/605 |
| 3,727,640 | 4/1973 | Sargeant | 137/889 |
| 4,123,800 | 10/1978 | Mazzei . | |
| 4,270,576 | 6/1981 | Takeda et al. . | |
| 4,285,367 | 8/1981 | Nommensen . | |
| 4,483,805 | 11/1984 | Glindsjo | 137/889 |
| 4,633,909 | 1/1987 | Louboutin et al. . | |
| 4,664,147 | 5/1987 | Maddock . | |
| 4,881,575 | 11/1989 | Smith | 137/889 |
| 4,960,042 | 10/1990 | Grossi | 137/893 |
| 5,159,958 | 11/1992 | Sand | 137/888 |
| 5,253,677 | 10/1993 | Sand | 137/888 |
| 5,338,113 | 8/1994 | Fissenko | 137/889 |

FOREIGN PATENT DOCUMENTS

| | | | |
|---|---|---|---|
| 1498342 | 2/1969 | Germany | 137/889 |

OTHER PUBLICATIONS

Chemical Engineers' Handbook, Third Ed., New York, N.Y., McGraw–Hill Book Co., Inc. 1950, pp. 1202–1203.

*Primary Examiner*—Denise L. Ferensic
*Assistant Examiner*—Ramyar Farid
*Attorney, Agent, or Firm*—Whitham, Curtis & Whitham; Howard J. Walter

[57] ABSTRACT

A fluid mixing system and a method of using same for maintaining uniform concentrations of fluid chemical additives in a dilutant, in which the system includes a multi-port aspirator device including a venturi having a venturi inlet for receiving dilutant and a venturi outlet of reduced diameter for discharging said dilutant, a dilutant injector source fluidly coupled to said multi-port aspirator device for delivering a dilutant at a dilutant pressure thereto, and a plurality of injectate sources fluidly connected to the aspirator device at or immediately downstream said venturi outlet, wherein each said injectate source is capable of independently varying pressure at said a multi-port venturi injector with respect to said dilutant pressure. The use of the inventive fluid mixing system also provides a facile and accurate means of injecting required volumes of wet chemicals into a flowing stream of a carrier fluid.

17 Claims, 3 Drawing Sheets

INTEGRATED DYNAMIC FLUID MIXING APPARATUS AND METHOD

BACKGROUND OF THE INVENTION

1. Field of the Invention

The invention relates to a chemical flow management (CFM) full flow processor chemical inject control aspiration system and a method of using same to inject a fluid additive into a primary carrier liquid.

2. Description of the Related Art

In the fabrication of integrated circuitry on a semiconductor wafer, it is imperative to maintain the purity and perfection of the material. For example, semiconductor wafers are routinely chemically cleaned after many processing steps to remove any unwanted organic films, heavy metals, particulates, and debris from the surface of the wafer. Also, wet etchants are often used in the removal of bulk material from a wafer surface, such as an etchant component of a slurry used in surface polishing operations or for local etching in fabrication steps used to delineate surface features. The cleaning and etching solutions used for these purposes usually are aqueous mixtures formed by dilution of a chemical reagent or concentrate, or a combination of such, in a dilutant. In semiconductor processing, the dilutant of choice is deionized water. The performance and aggressiveness of the cleaning solution can be a strong function of the dilution rate of active chemical(s). Due to the fineness of microcircuitry, any inadvertent fluctuations in the mixing ratios of the chemical reagents with water can adversely impact and frustrate efforts at quality control. Therefore, consistent and reliable control of the mixing procedure used in preparing the cleaning and etching solutions used in IC chip fabrication is very important and highly desired.

A conventional CFM tool used in semiconductor applications generally prepares process solutions by injecting or entraining chemical concentrates or other chemical reagents into a stream of continuously flowing deionized water. Semiconductor processing wet tools have used mechanical devices in combination with a pneumatic chemical injection system to control the flow rate of required chemical additives into the processing chamber of the wet tool when called for by the process program. In the conventional systems, the water pressure is adjusted to adjust the amount of chemical injection and, consequently, the chemical injection is inversely proportional to the water pressure/flow.

A conventional CFM tool 10 is illustrated in FIG. 1. An injection tube cylinder 11 is filled with the chemical reagent or additive, and the additive is pressurized at the proper time using dome-loaded regulator 14. The opening of a needle valve 12 is manually adjusted initially to provide a predetermined volume of wet chemical reagent via feed line 16 at a specified pneumatic pressure over a finite period of time. The additive(s) is supplied then flows through manually-adjusted needle valve 12 and mixes with the dilution water supplied via carrier liquid source stream 15 in a sampling valve 13. A sampling valve is a standard piping component with a large bore and which is constantly open, and a small side tap which is isolated by a normally closed valve. This allows a small amount of the stream flowing through it to be sampled, or conversely a small amount of an additive to be injected into the main flowing stream. A standard 0.25 inch (0.64 mm) PFA adjustable needle valve installed in a manifold has been used as needle valve 12. To achieve a range of flow requirements, the pneumatic pressure is adjusted correspondingly. Namely, the mixing ratio is controlled by adjusting the cylinder pressurization in the injection tube 11 by use of the dome loaded regulator 14, which acts against a resistance controlled by adjustment of the needle valve 12 and the head pressure of the water at the sampling valve 13. The mixture of additive and dilutant water is conducted to wafer processor 17 for usage.

This conventional CFM system allows a dynamic range in the mixing ratio of 2.5× (e.g., the system can supply chemicals at a ratio of 100:1 to 250:1). This mixing ratio is bounded by the pressure ratings of the components in the injection tube 11 assembly at its upper limit and by the static pressure of the water the system is injecting against. The timing, pressure and valve adjustments all must be controlled in a coordinated manner to give an accurate injection of the chemical in this conventional system. Also, the static pressure of the deionized water at the injection point is well above atmospheric pressure in this conventional system. This property tends to restrict the dynamic range possible in the mixing ratio of water and injectate for the injection system. In this regard, it will be appreciated that in any flow system, the fluid exerts two pressures on its surroundings. One being the dynamic pressure exerted against a surface perpendicular to the direction of flow, and the other being a static pressure exerted against a surface, such as a pipe wall, oriented parallel to the direction of flow. At the point of injection, the injectate is being injected through a hole in the pipe wall; hence, the injectate is injected against the static pressure of the flowing deionized water.

Furthermore, the conventional flow mixing system has been unstable with respect to the ratio of the flow rate of the injected additive (and consequently the chemical concentration in the processing solution). In this conventional system depicted in FIG. 1, the mixing process was based on changing pressure to adjust the amount of chemical injection, and, therefore, the chemical injection was inversely proportional to the water pressure/flow. At any time, the instantaneous rate of flow of the additive (injectate) would be proportional to the pressure difference between the pressure applied to the injection tube 11, which is a fixed pressure, and the head pressure of the water at the mixing point within sampling valve 13. A transient increase in the water flow rate would cause an increase in this pressure. As the injection pressure of the additive is fixed, the change in P ($\Delta P$) for the additive suffers a decrease, resulting in a proportional decrease in the additive flow. As a consequence, any transient change in the water flow rate would undesirably induce the opposite effect in the additive flow rate.

The impact of this effect is magnified by the way in which the CFM tool is typically used. Namely, the most critical and sensitive cleaning and etching operations are carried out at high dilution ratios of the etchant chemical in the carrier fluid. In order to preserve the dynamic range of the CFM tool under these circumstances, the needle valve 12 is adjusted so that these injections take place at low pressure. However, as the error in flow is proportional to the ratio of the transient pressure excursion to the desired $\Delta P$ for the injected additive, the relative error in flow for a given pressure excursion is magnified under these conditions. As a consequence, the adjustment and control of these mechanical devices and pneumatic injection systems is very complicated and often inaccurate, especially at lower chemical flow volumes.

SUMMARY OF THE INVENTION

It is an object of the present invention to provide a a simpler and more accurate means of injecting required volumes of wet chemicals into a flowing stream of a carrier fluid.

It is another object of the present invention to provide a means which repetitively accurately and reliably controls the volumetric increments of fluid chemicals injected into a flowing stream of liquid over multiple operations.

It is yet another object of the present invention to provide a method of providing a self-compensating system wherein the chemical additive concentration changes proportionally to a change in the flow volume of the carrier fluid to maintain a constant concentration of the additive in the mixture of fluids.

These and other objects, advantages, and benefits are achieved in the present invention through the use of a fluid mixing system providing a constant process fluid concentration using a multi-port aspirator device in conjunction with a variable pressurized chemical injection cylinder which supplies injectate to the aspirator device. The inventive fluid mixing system accurately, reliably and repeatably controls the required volume of one or more fluid chemicals injected into a flowing stream of carrier liquid. The present invention permits incremental injection of amounts of chemical additive into a carrier liquid stream to provide consistent dilution strengths.

In one embodiment of the present invention, there is a fluid mixing system having a multi-port aspirator device including a venturi used to entrain injectate for admixture with dilutant. A dilutant injector source is fluidly coupled to the multi-port aspirator device for delivering a dilutant at a dilutant pressure thereto, and a plurality of injectate sources are fluidly connected to the aspirator device at or immediately downstream of the outlet of the venturi in the aspirator device. The injectate sources each have the capability to independently vary the pressure exerted on the injectate with respect to the dilutant pressure.

In another embodiment of the invention, the fluid mixing aspirator device of this invention is used in a method of mixing injectate and dilutant fluids which maintains a uniform concentration of injectate in the mixture.

In the present invention, the dynamic mixing range for dilutants and injectates is increased to provide a more versatile invention having mixing accuracy over a wider range of mixing values. The "dynamic range" means the feasible range of mixing ratios of water and injectate for the injection system. The dynamic range is proportional to the difference between the allowable pressure on the injection tube or cylinder used for the injectate sourcing and the static pressure of the deionized water at the injection point for injectate in the aspirator device.

The venturi passage is provided intermediate the ends of the primary flow channel of the aspirator device, and it effectively reduces the diameter of the flow passage such that a low pressure region is created at the outlet region of the venturi (i.e., the injection/mixing point), which causes injectate fluids to be drawn into the primary carrier stream of dilutant as it exits the venturi. Therefore, in the inventive system, the static pressure of the deionized water at the injection/mixing point in the aspirator device is negative, i.e., below atmospheric pressure due to Bernoulli effect, which, in turn, permits a wider dynamic range to be achieved.

Furthermore, the inventive system is stable relative to injection ratio. Increasing the velocity of the aspirating fluid, which is the dilutant or carrier fluid (e.g., deionized water), proportionally increases the static pressure depression. For a constant injection pressure, this has the effect of increasing the chemical concentrate $\Delta P$, and hence the flow rate, to correspond with the increase in dilutant flow. Therefore, the present inventive system is self-compensating in relation to transient dilutant flow and will provide a constant process fluid concentration. Thus, in the present invention, the system is self-compensating wherein the chemical additive concentration increases proportionally to an increase in the dilutant liquid flow. As a consequence, multiple chemical additives can be delivered for mixture with the dilutant without the need to change the pressure of the injectates in order to adjust the amount of any chemicals injected. The inventive fluid mixing device and system enables a constant process fluid concentration of one or more additives to be achieved and maintained.

These and other objects, advantages and features of the invention will become more fully apparent from the several drawings and description of the preferred embodiments.

DETAILED DESCRIPTION OF THE PREFERRED EMBODIMENTS OF THE INVENTION

Figure 1:
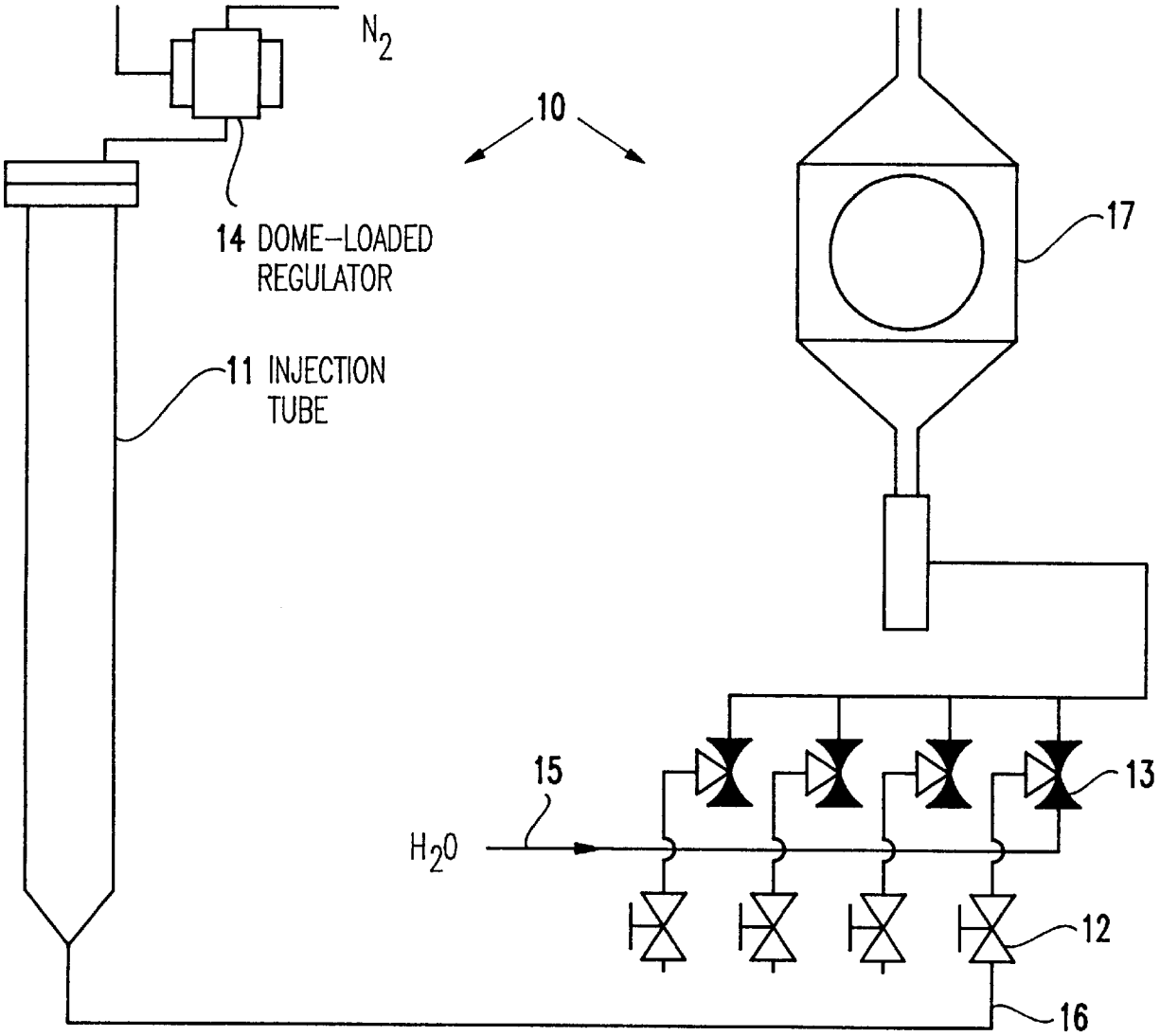
FIG. 1 PRIOR ART
FIG. 1 is a schematic view of a conventional system for injecting a chemical additive into a primary carrier stream.
Figure 2:
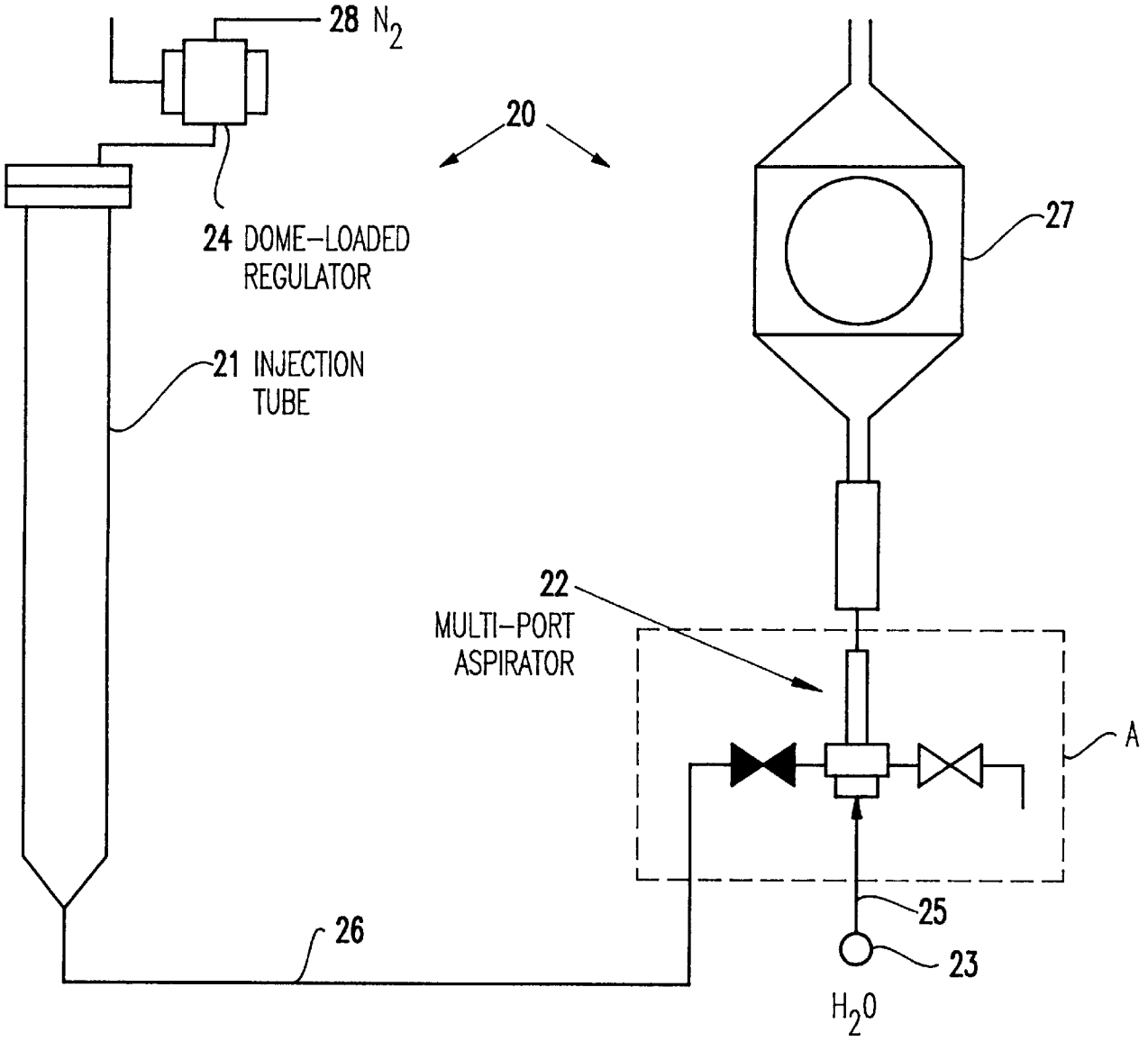
FIG. 2 is a schematic view of the inventive system for injecting a chemical additive into a primary carrier stream.

Referring now to the drawing, and more particularly to FIG. 2, there is shown a schematic view of a CFM system 20 for injecting a liquid chemical additive into a primary carrier liquid stream using a fluid mixing aspirator device according to the present invention. A chemical additive, also referred to herein as injectate, is filled into injection tube 21, which is a self-compensating pressure injection cylinder that can respond to pressure differential. Additive (injectate) fluid filled into the injection tube is fluidly conducted via piping or tubing 26 to a mixing chamber, described in more detail below, located within the fluid mixing aspirator device 22 of this invention. While FIG. 2 illustrates only a single injectate source 21/26 to simplify the drawing, it will be understood that if a plurality of different additives need to be dispensed into the dilutant, then each different type of injectate can be fed from a separate injection tube and feed line system to dedicated inlet ports in aspirator 22. In this way, a plurality of injectate sources can be utilized. Dilutant fluid, also referred to herein as diluent or aspirating fluid, is supplied under pressure via piping or tubing 25 from a dilutant source 23 to the aspirator device 22 for mixing with the additive fluid(s). For semiconductor cleaning and etching operations, the primary component or sole component of the dilutant fluid generally will be deionized water. The cylinder pressurization in the injection tube 21 is adjusted by use of a dome loaded regulator 24 using pressurized gas (e.g. nitrogen) 28, which acts against a resistance controlled by adjustment of the head pressure of the water. The mixture of dilutant and injectate fluid brought about in the multi-port aspirator 22 is subsequently conducted to wafer processor 27 for usage.

Figure 3:
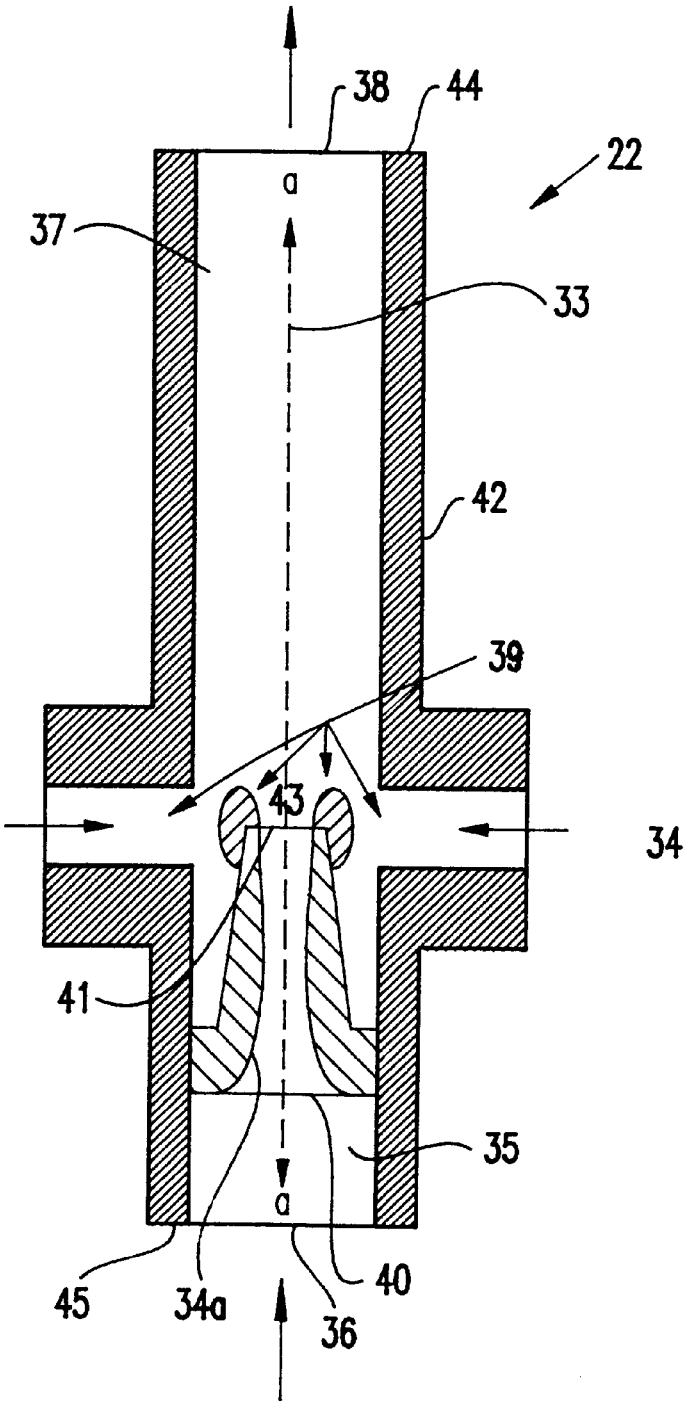
FIG. 3 is a cross-sectional view of the flow handling devices within area "A" defined by imaginary hatched lines in FIG. 2.

As illustrated in FIG. 3, the multi-ported aspirator 22 includes a cylindrical housing 42 as a main body part defining an inner primary flow channel 33 for passage of the dilutant fluid, which is the carrier liquid into which the liquid additive(s) (i.e., the injectate(s)) will be injected. A venturi structure 34 is placed within the ends 44, 45 of the primary flow channel 33 along a central axis a—a of flow. The venturi structure 34, as depicted, has an internal conical shape providing an inner constricting throat portion 34*a* of decreasing diameter from its inlet 40 on the upstream side 35 of the aspirator device 22 to its outlet 41 located on the downstream side 38 of the aspirator device 22. The upstream side 35 of the aspirator device 22 has an inlet port 36 for introduction of the dilutant in the direction indicated by the arrow in FIG. 3. The downstream side 37 of the aspirator device 22 has an outlet port 38 where the mixed dilutant and injectate exit the aspirator device 22 in the direction indicated by the arrow. Four injectate ports 39 are provided at circumferentially spaced apart locations on the periphery of cylindrical housing 42 immediately near or downstream of outlet 41 of the venturi 34 for injection of injectate(s) liquids into the diluent stream as the dilutant exits the venturi 34 whereupon the injectate and dilutant fluids admix together.

The venturi 34 accelerates aspirating fluid (diluent) past the injectate ports 39, lowering its static pressure at this mixing zone 43 by Bernoulli effect to create a partial vacuum which sucks and thus entrains injectate (additive) fluids in through the injectate ports 39, as indicated by the direction arrows in FIG. 3, where it mixes with the diluent in the outlet side 33 of the aspirator device 22. This multi-ported aspirator system 22 can provide for stability of the mixing ratio of diluent and injectate fluids as well as enable finite control of the chemical mixture due to the fact that the chemical injection is proportional to the dilutant (water) pressure flow.

The plurality of inlet ports 39 can be individually and controllably plugged or connected to each additive supply line as needed, depending on the particular cleaning/etching operation to be supported by the CFM process tool of the invention. Each of the injectate sources has the capability to independently vary pressure at the multi-port venturi injector with respect to the dilutant pressure.

The multi-ported aspirator 22 can be made of materials which preferably are relatively inert to the presence of standard etchants and cleaning fluids used in semiconductor processing, such as molded plastic (e.g., PVC or polyolefins).

In operating the inventive CFM tool, a dilutant fluid is provided to said dilutant inlet port 36 at a first nominal pressure and an injectate fluid is provided to said injectate inlet ports 39 at a second nominal pressure. The second pressure is regulated with respect to the first pressure to provide a predetermined concentration of injectate in the dilutant at the outlet 41 of the venturi injector 34.

This inventive CFM system provides for stability of the mixing ratio as well as finite incremental control of the chemical mixture due to the fact that the chemical injection is proportional to the water pressure flow.

The inventive processing equipment is provided for low concentration chemical using a variable pressurized chemical injection cylinder in conjunction with a multi-port aspirator.

While the invention has been described in terms of a specific embodiment, further modifications and improvements will occur to those skilled in the art. For instance, while the main body part of the mixing device of the aspirator device has been exemplified as a cylindrical shaped conduit, other pipe and duct shapes are possible within the scope of this invention. It is to be understood, therefore, that this invention is not limited to any particular forms illustrated and that it is intended in the appended claims to cover all modifications that do not depart from the spirit and scope of this invention.

What is claimed is:

1. A closed fluid mixing system, comprising:

a multi-port aspirator device comprising a main body part defining an inner primary flow channel between a dilutant inlet portion for introducing dilutant liquid into said primary flow channel and a mixture outlet port for discharging mixed dilutant liquid and injectate liquid, said multi-port aspirator device further including a venturi located within said primary flow channel, said venturi having a venturi inlet for receiving said dilutant liquid and a venturi outlet of reduced diameter for discharging said dilutant liquid;

a dilutant injector source fluidly coupled to said multi-port aspirator device for delivering said dilutant liquid at a dilutant pressure lying within a predetermined range above atmospheric pressure;

at least one injectate source fluidly connected to said aspirator device, where said injectate source is fluidly connected to one of a plurality of injectate inlet ports located around a periphery and through said main body part a locations radially adjacent or immediately downstream to said venturi outlet;

at least one variable gas pressurized injection cylinder coupled to said injectate source, said cylinder applying pressure to an injectate liquid supplied from said injectate source to cause said injectate liquid to be injected into said one of said injectate inlet ports at a desired pressure lying within a range above atmospheric pressure, said desired pressure created by said cylinder and said dilutant pressure forming a predetermined dilutant liquid-to-injectate liquid ratio at a mixing point located proximate said venturi outlet, said cylinder varying pressure of said injectate liquid independent from said dilutant pressure; and means, including said venturi for compensating for variations in a flowrate of said dilutant liquid at said dilutant inlet portion regardless of properties of said dilutant flowrate, said means increasing a flowrate of said injectate liquid at said mixing point for increases in said dilutant flowrate and decreasing the flowrateof said injectate liquid at said mixing point for decreases in said dilutant flowrate to thereby maintain said predetermined dilutant liquid-to-injectate liquid ratio.

2. The fluid mixing system of claim 1, wherein said venturi has a decreasing diameter extending from said venturi inlet to said venturi outlet.

3. The fluid mixing system of claim 1, wherein said main body part comprises a cylindrical housing.

4. A method of mixing fluids in a closed fluid mixing system, comprising the steps of:

providing a fluid mixing device having a main body part defining an inner primary flow channel between a dilutant inlet port for introducing dilutant liquid into the primary flow channel and a mixture outlet port for discharging a mixture of dilutant liquid and injectate liquid, a venturi located within said primary flow channel having a venturi inlet for introducing said dilutant and a venturi outlet for discharging said dilutant liquid, and a plurality of injectate inlet ports provided around the periphery and through the main body part at locations radially adjacent or immediately downstream to said venturi outlet of said venturi to permit fluid communication by injectate liquid therethrough;

providing a dilutant liquid at a first pressure lying in a predetermined range above atmospheric pressure to said dilutant inlet port;

providing at least one has pressurized injectate liquid at a second pressure to one of said injectate inlet ports, said second pressure lying within a range above atmospheric pressure;

regulating said second pressure independently from said first pressure to mix said dilutant liquid and said injectate liquid at a predetermined dilutant liquid-to-injectate liquid ratio; and compensating for variations in a flowrate of said dilutant liquid at said dilutant inlet portion regardless of properties of said dilutant flowrate, said compensating step including allowing said venturi to increase a flowrate of said injectate liquid at said mixing point for increases in said dilutant flowrate and to decrease the flowrate of said injectate liquid at said mixing point for decrease in said dilutant flowrate to thereby maintain said predetermined dilutant liquid-to-injectate liquid ratio.

5. The method of claim 4, wherein said dilutant liquid is water.

6. The method of claim 4, wherein said injectate liquid is a cleaning liquid.

7. The method of claim 4, wherein said injectate liquid is a semiconductor etching liquid.

8. The method of claim 4, further comprising the steps of:

conducting said mixture of dilutant liquid and dilutant injectate discharged from said outlet port to a semiconductor wafer processor; and contacting a semiconductor wafer with said mixture of dilutant liquid and injectate liquid.

9. The method of claim 8, wherein said dilutant liquid is water.

10. The method of claim 8, wherein said injectate liquid is a cleaning liquid.

11. The method of claim 8, wherein said injectate liquid is a semiconductor etching liquid.

12. The method of claim 8, wherein said fluid mixing device comprises a plastic material.

13. The method of claim 4, wherein said a mixture of dilutant liquid and injectate liquid discharged from said outlet port is devoid of a gas phase.

14. The method of claim 8, wherein said a mixture of dilutant liquid and injectate liquid discharged from said outlet port is devoid of a gas phase.

15. The method of claim 8, further comprising changing said first nominal pressure, wherein said predetermined concentration of said injectate liquid in said mixture remains constant after said change in said first nominal pressure.

16. The fluid mixing system of claim 1, wherein said multi-port aspirator device comprises a plastic material.

17. The method of claim 4, further comprising:

providing a plurality of injectate liquids at respective second pressures to respective ones of said injectate inlet ports.

* * * * *